US006207105B1

(12) United States Patent
Woods

(10) Patent No.: US 6,207,105 B1
(45) Date of Patent: Mar. 27, 2001

(54) WEAR RESISTANT NICKEL ALLOYS AND METHODS OF MAKING SAME

(75) Inventor: Charles M. Woods, West Manchester, OH (US)

(73) Assignee: Global Manufacturing Solutions, Inc., Franklin, OH (US)

( * ) Notice: Subject to any disclaimer, the term of this patent is extended or adjusted under 35 U.S.C. 154(b) by 0 days.

(21) Appl. No.: 09/467,391

(22) Filed: Dec. 20, 1999

Related U.S. Application Data

(60) Provisional application No. 60/113,924, filed on Dec. 28, 1998.

(51) Int. Cl.[7] ..... C22C 19/03
(52) U.S. Cl. ..... 420/457; 420/458; 148/429
(58) Field of Search ..... 420/457, 458; 148/429

(56) References Cited

U.S. PATENT DOCUMENTS 3,282,689 * 11/1966 Santner ..... 75/170
3,915,760 * 10/1975 Wenderott ..... 148/11.5

FOREIGN PATENT DOCUMENTS

2345882 * 9/1973 (DE) .
46-033383 * 9/1971 (JP) .
52041120 * 9/1975 (JP) .
53-125219 * 11/1978 (JP) .
357251 * 10/1972 (SU) .
483216 * 9/1975 (SU) .
954476 * 8/1982 (SU) .

OTHER PUBLICATIONS

ASM Handbook c 1990, vol. 2; pp. 435–436.*
Dean, A.V.; Age hardening in nickel 30% copper alloys containg titanium and aluminum, Jun. 1972 pp. 181–184.*

* cited by examiner

*Primary Examiner*—Daniel J. Jenkins
*Assistant Examiner*—Nicole Coy
(74) *Attorney, Agent, or Firm*—Biebel & French

(57) ABSTRACT

A wear-resistant Ni\Cu alloy and methods of preparing same are disclosed. The alloy comprises a ductile, continuous phase of Ni\Cu with a discontinuous phase of hardened Ti containing particles distributed throughout the continuous phase. The particles are Ti\Al intermetallic or complex $Ti_xAl_yNi_z$ complex or particle. The alloying components are poured and mixed in the melt under an inert atmosphere, then slowly cooled to provide the desired cast article. The alloy should be protected during melting and cooling in a protective atmosphere, such as a vacuum, or an inert atmosphere so as to inhibit oxide and nitride formation that would otherwise adversely affect desirable alloy properties.

5 Claims, 3 Drawing Sheets

WEAR RESISTANT NICKEL ALLOYS AND METHODS OF MAKING SAME

CROSS REFERENCE TO RELATED APPLICATION

The benefit of U.S. provisional patent application 60/113,924, filed Dec. 28, 1998 is hereby claimed.

BACKGROUND OF THE INVENTION

Animal and vegetable rendering presses and the like include a variety of working parts such as screw flights, breaker bars and pins and metallic screens that are subjected to excessive shear conditions during the kneading and working of the abrasive animal or vegetable medium in the press. In animal rendering operations, the work medium is acidic, and accordingly, the working parts must be capable of enduring in this corrosive environment in addition to fulfilling the requirement of good wear resistance.

In many cases, carbon steel, Ni, Cr and B alloys have been used to make such press parts but, in the long run, these parts exhibit an undesirable brittleness or excessive corrosion that may lead to fracture.

Ni\Cu Monel alloys with minor amounts of Si addition thereto are known as being corrosion resistant in many acidic mediums. However, brittle suicides may be present in these alloys and this leads not only to difficulty in machining of the desired parts but also to the possible fracture failure of the part during prolonged use.

There is accordingly a need in the art for the provision of fracture tough, ductile metallic parts that exhibit high impact strengths so that such parts can be used as working parts in the expression, kneading or shearing of abrasive materials. There is an even more specific need for the provision of such parts that are corrosion resistant in acidic media.

SUMMARY OF THE INVENTION

The present invention is directed to a specialty alloy specifically formulated to produce an as-cast structure comprising a ductile phase and a hard particle phase distributed throughout the ductile phase. The ductile phase is a matrix of gamma phase consisting primarily of nickel and copper. A fine distribution of hard gamma prime phase particles, consisting mainly of titanium aluminum intermetallic, is prevalent throughout the bulk of the material. The alloy is unique, in that it forms the hard particle distribution throughout the bulk of the material and it does this during the slow cooling phase of the casting process. This alloy must cool slowly to adequately form the hard particles. That is why the alloy is so well suited to the casting process, which is a naturally slow cooling process. This combination of structures results in an alloy that has excellent wear resistance, due to the hard particles, and good strength, toughness and ductility due to the ductile matrix. Also, the combination of elements, primarily nickel and copper, gives this alloy superior corrosion resistance.

The invention will be further described in conjunction with the appended drawings and following detailed description.

DETAILED DESCRIPTION OF THE PREFERRED EMBODIMENT

Figure 1:
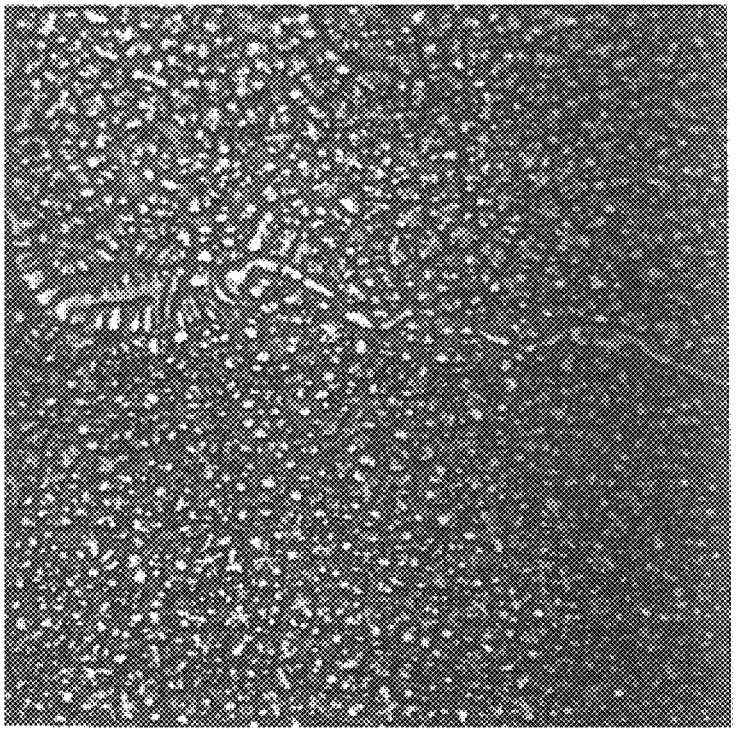
FIG. 1 is a photomicrograph of the alloy (etchant Fe $Cl_3$/HCl) in accordance with the invention taken near the bottom of a cast billet at 1000X.

Alloy compositions in accordance with the invention comprise a Ni\Cu matrix and a hard particle phase distributed throughout the matrix. The hard particle phase comprises Ti containing particles, specifically an intermetallic Ti\Al complex. Exemplary compositions comprise about 40–80 wt % Ni; about 20–40 wt % Cu; about 0.10–10 wt % Ti and about 0.10–10 wt % Al. Other metals selected from the group consisting of Si, Mn, Fe, Zr may be present in amounts of from about 0.1–2 wt %. (All of the foregoing wt % ranges are adjusted so that the total composition is 100 wt %.)

Preferred alloy compositions are as follows:

| | |
|---|---|
| Ni | 40–80 wt % |
| Cu | 20–40 wt % |
| Si Metal | 0.1–0.5 wt % |
| Mn | 0.1–2.0 wt % |
| Ti | 1–8 wt % |
| Fe | 0.1–2 wt % |
| Zr | 0.1–2 wt % |
| Al | 1–8 wt % |

With the foregoing adding up to 100 wt %.

At present the most preferred alloy composition is as follows:

| | |
|---|---|
| Ni | 62 wt % |
| Cu | 29 wt % |
| Si Metal | 0.3 wt % |
| Mn | 0.5 wt % |
| Ti | 3.5 wt % |
| Fe | 0.9 wt % |
| Zr | 0.3 wt % |
| Al | 3.5 wt % |

A typical furnace charge mix for the alloy is as follows:

| | |
|---|---|
| Ni | 62 lb |
| Cu | 29 lb |
| Si Metal | 0.35 lb |
| El Mn | 0.5 lb |
| Ti Sponge | 1.8 lb |
| Fe Ti | 2.5 lb |
| Zr Sponge | 0.3 lb |
| Al Shot | 3.6 lb |

Ni, Cu, Mn, Si, FeTi, and the Zr sponge are added to the melt at the initial charge. The Zr and FeTi help to degas the initial charge and remove excess oxygen and nitrogen from the metal as it melts. The Al shot and Ti sponge are added immediately before the metal is poured to assure good homogenization without risking the loss of these elements to reaction with any dissolved oxygen and nitrogen over time during the melting process.

The pours are conducted in either a vacuum or an inert atmosphere so as to inhibit formation of brittle oxide and nitrides in the alloy. Preferably, an inert atmosphere comprising argon or helium is chosen. Introduction of even small quantities of air into the melt results in reaction with oxygen and nitrogen and forms many embrittling phases.

In accordance with the invention, a hard, tough precipitate, discontinuous phase is formed throughout the continuous phase. It is thought that the discontinuous phase is a TiAl intermetallic or complex particle or a $Ti_xAl_yNi_z$ complex or particle. The continuous phase is primarily Ni\Cu.

The components are poured and mixed in the melt under an inert atmosphere, then a slow cooling at ambient or reduced temperatures is provided to result in the desired alloy. The alloy should still be protected via an inert atmosphere during cooling to ensure that undesirable reactions with oxygen or nitrogen, for example, do not occur.

Normally, the metal is poured into a preheated ceramic shell and then allowed to cool to the surrounding environment; normally ambient temperature, although other cooling environments can also be used. Preferably, the alloy is allowed to cool for a period of 12 hours or more.

EXAMPLES

The invention will be further described in conjunction with the following examples which are intended as being illustrative only and should not be construed to limit the invention.

Example 1

A pour was made from the following:

| | |
|---|---|
| Ni | Rem |
| Cu | 29.1 wt % |
| Si Metal | 0.26 wt % |
| Mn | 0.51 wt % |
| Ti | 3.41 wt % |
| Fe | 0.45 wt % |
| Zr | 0.27 wt % |
| Al | 3.42 wt % |

Figure 4:
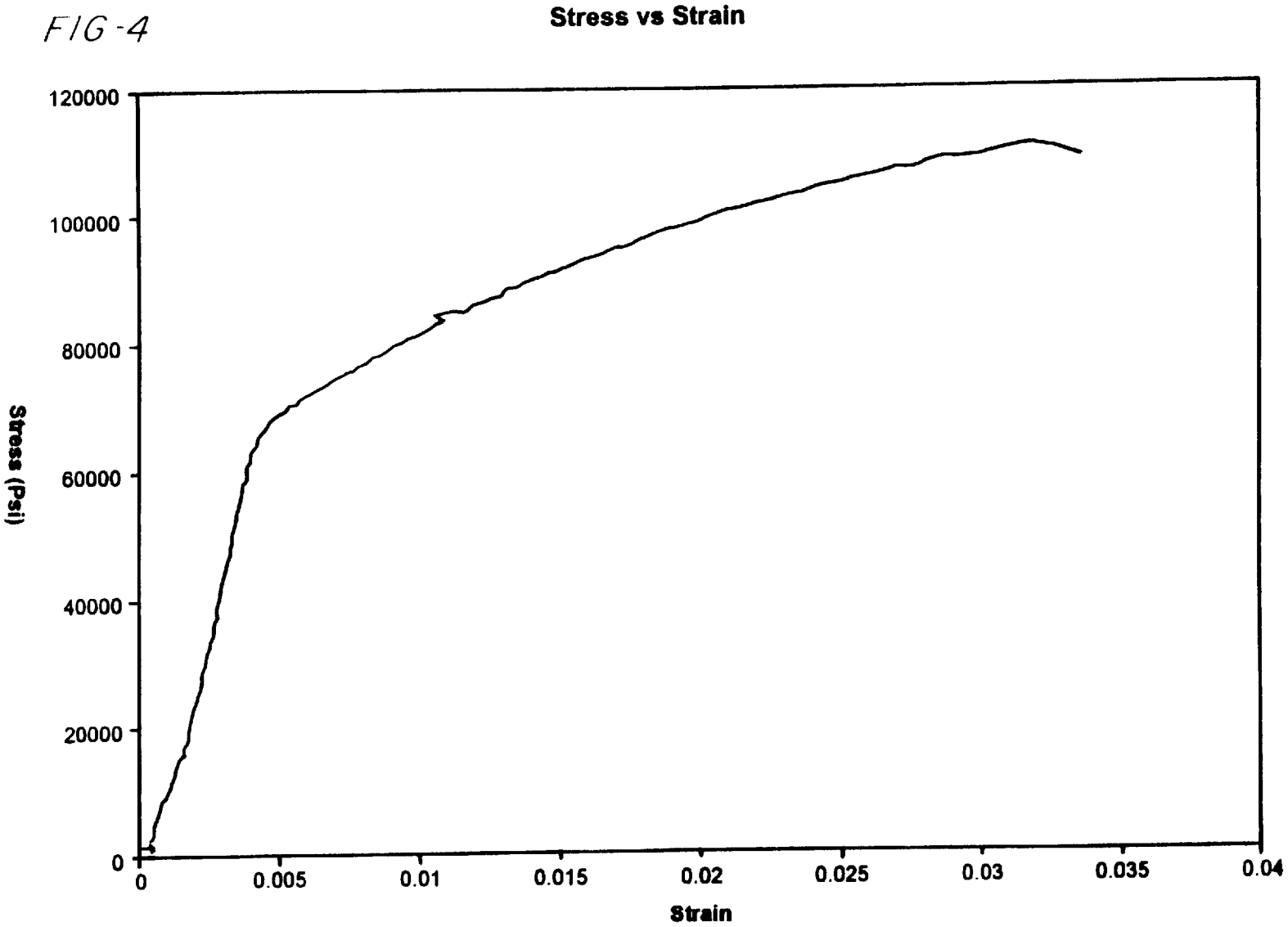
FIG. 4 is a stress/strain graph of the alloy made in accordance with example one.

The pour was conducted in an argon atmosphere and the molten alloy was allowed to cool at room temperature for a period of about 12 hours. FIG. 4 is a stress/strain curve for this alloy.

Example 2

A pour was made from the following:

| | |
|---|---|
| Ni | Rem |
| Cu | 28.2 wt % |
| Si Metal | 0.29 wt % |
| Mn | not measured |
| Ti | 3.94 wt % |
| Fe | 2.58 wt % |
| Zr | 0.27 wt % |
| Al | 3.50 wt % |

This pour was conducted in an argon atmosphere and the melt was allowed to cool to form a cast structure at room temperatures for about 12 hours.

The metallography from this pour showed an excellent microstructure with a small gamma prime phase surrounded by the ductile gamma phase. Grain boundary precipitates consisted of finely divided gamma prime as well. There was no evidence of perovskite formation or of any of the other deleterious crystal structures that can form in this alloy when the atmosphere is not controlled during the melt pour. This microstructure is shown in FIGS. 1–3 below.

FIG. 1 shows the microstructure near the bottom of the billet. Notice the fine gamma prime in the matrix and along a grain boundary. Here, the microstruture photograph was taken from the bottom of the billet. This means that the microstructure at the center of the billet will show even finer precipitates of the gamma prime phase.

Figure 2:
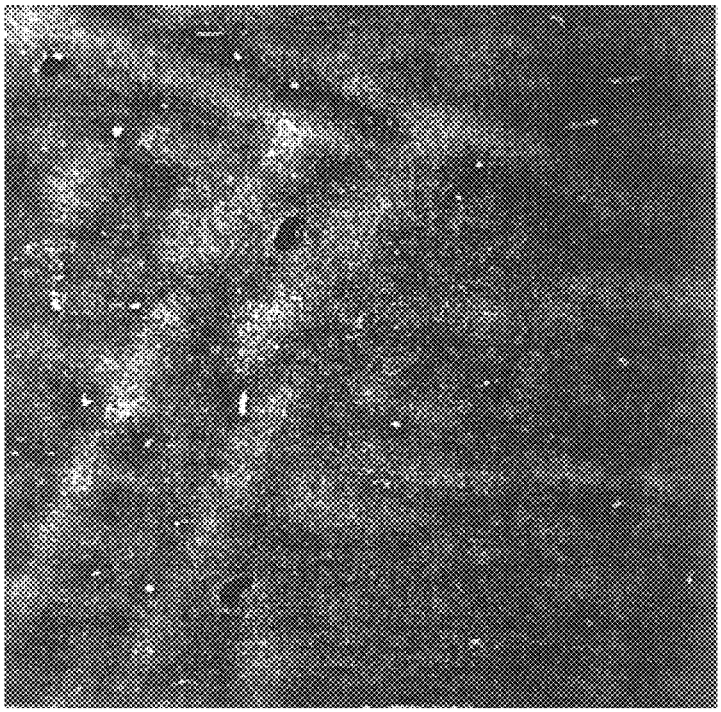
FIG. 2 is a photomicrographic of the alloy shown in FIG. 1 taken near the bottom of the billet at 50X.

FIG. 2 shows the microstructure taken near the bottom of the billet. Notice the interlocking dendritic structure. Porosity is due to quench layers formed from chilling that occurred during the pour into the cold mold. This porosity disappears as one proceeds further into the center of the billet away from the surface.

Figure 3:
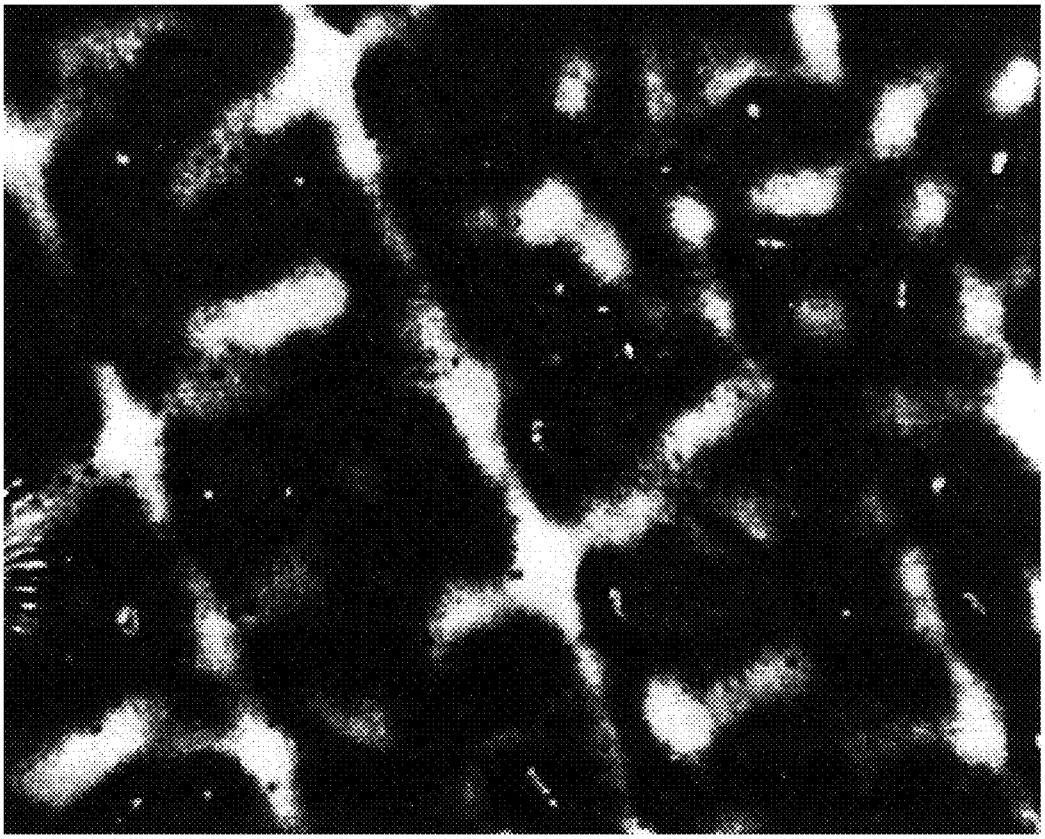
FIG. 3 is a photomicrograph of the alloy shown in FIG. 2 at 100X.

FIG. 3 shows the microstructure at 100X showing macrosegregation of Ni and Cu resulting in an interlocking dentritic structure.

The fine precipitates that form during the alloying produce good wear resistance properties in the alloy. This is also an additional benefit gained from the secondary microstructure features. FIGS. 2 and 3 show an interlocked dentritic structure that acts like a zipper mechanism when fracture occurs. This alloy separates along these interlocking boundaries and creates a natural crack arresting mechanism that aids in the enhanced fracture toughness of the material.

In accordance with the above, it is evident that a hard, tough percipitate discontinuous phase is formed throughout the continuous phase. It is thought that the discontinuous phase is a Ti Al intermetallic or complex particle, such as a $Ti_xAl_yNi_z$ complex or particle. The continuous phase is primarily Ni\Cu.

The components are poured and mixed in the melt under an inert atmosphere, then a slow cooling at ambient or reduced temperature is provided to result in the desired alloy. The alloy, as mentioned above, should be protected via an inert atmosphere or vacuum during pouring and cooling to ensure that undesirable reactions with oxygen or nitrogen, for example, do not occur.

Normally, the metal is poured into a preheated ceramic shell and then allowed to cool to the surrounding environment. Preferably, the alloy is allowed to cool for a period of 12 hours or more.

The casting cooled alloy is particularly useful in the fabrication of machine wear parts for industrial applications where enhanced wear resistance of the part is desired. For example, cast alloys in accordance with the invention can be used to make screws, screw flightings, breaker pins or bars or metallic screens or filters for animal rendering, oil seed, latex dewatering, and other extraction machines. Additionally, the alloy will be useful in the preparation of wear parts for pulp and paper machines, disintegrators, pulverizers, and compaction machines.

While I have shown and described herein certain embodiments of the present invention, it is intended that there be covered as well any change or modification therein which may be made without departing from the spirit and scope of the invention as defined in the appended claims.

What is claimed is:

1. Alloy composition comprising an Ni/Cu matrix and a hard particle phase distributed throughout said matrix, said hard particle phase comprising Ti/Al intermetallic particles said composition further comprising Zr.

2. Alloy composition comprising from about 40–80 wt % Ni; about 20–40 wt % Cu; about 3.5 wt % to about 10 wt % Ti and about 3.5 wt % to about 10 wt % Al, said composition further characterized by having Ti/Al intermetallic particles therein dispersed within a ductile phase of primarily Cu and Ni.

3. Composition as recited in claim 2 further comprising about 0.1–2 wt % of Zr.

4. Alloy composition as recited in claim 2 wherein said Al is present in an amount of about 3.5 wt % and wherein said Ti is present in an amount of about 3.5 wt %.

5. Alloy composition consisting essentially of about 62 wt % Ni, about 29 wt % Cu, about 0.3 wt % Si metal, about 0.5 wt % Mn, about 3.5 wt % Ti, about 0.9 wt % Fe, about 0.3 wt % Zr and about 3.5 wt % Al, with the foregoing adding up to 100 wt %.

* * * * *